US012472550B2

(12) United States Patent
Fukumoto

(10) Patent No.: US 12,472,550 B2
(45) Date of Patent: Nov. 18, 2025

(54) PREFORM OF A CAN AND METHOD OF MANUFACTURING THE SAME

(71) Applicant: TOYO SEIKAN CO., LTD., Tokyo (JP)

(72) Inventor: Hayato Fukumoto, Kanagawa (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 387 days.

(21) Appl. No.: 18/115,025

(22) Filed: Feb. 28, 2023

(65) Prior Publication Data

US 2023/0201908 A1 Jun. 29, 2023

Related U.S. Application Data

(63) Continuation of application No. PCT/JP2021/022873, filed on Jun. 16, 2021.

(30) Foreign Application Priority Data

Sep. 10, 2020 (JP) ..... 2020-152159

(51) Int. Cl.
*B21D 51/26* (2006.01)
*B65D 1/16* (2006.01)

(52) U.S. Cl.
CPC ..... *B21D 51/2669* (2013.01); *B65D 1/165* (2013.01)

(58) Field of Classification Search
CPC .... B21D 51/26; B21D 22/30; B21D 51/2638; B21D 51/263; B21D 51/265; B21D 51/2669; B65D 17/02
(Continued)

(56) References Cited

U.S. PATENT DOCUMENTS 3,693,828 A * 9/1972 Kneusel ..... B05B 13/0681 220/608
3,811,393 A 5/1974 Close
(Continued)

FOREIGN PATENT DOCUMENTS

CH 577861 A5 7/1976
JP H4-123825 A 4/1992
(Continued)

OTHER PUBLICATIONS

WO2020/158355, 2020, Japan, Kobayashi, Tomomi, English translation.*

(Continued)

*Primary Examiner* — Ernesto A Grano
(74) *Attorney, Agent, or Firm* — BACON & THOMAS, PLLC

(57) ABSTRACT

A preform of a can includes: a dome part being concave into the bottomed cylindrical body; and an annular leg part projecting in a direction opposite to a direction in which the dome part is concave, the dome part and the annular part being molded to form the preform of the can, and an inner surface of the dome part being pressed to mold a molded can. A maximum height of the preform of the can from a ground plane to the dome part is greater than a maximum height of the molded can from a ground plane to the dome part. In a vertical cross-sectional view, a length of an inner peripheral section of the leg part connecting between a ground point of the leg part and the dome part of the preform of the can is greater than a length of a curved end molded around the dome part of the molded can.

3 Claims, 11 Drawing Sheets

(58) Field of Classification Search
USPC ..... 215/373
See application file for complete search history.

(56) References Cited

U.S. PATENT DOCUMENTS 4,515,284 A * 5/1985 Lee, Jr. ..... B65D 1/165 220/606
4,685,582 A * 8/1987 Pulciani ..... B65D 1/165 D9/518
4,834,256 A * 5/1989 McMillin ..... B65D 21/0217 220/606
4,885,924 A * 12/1989 Claydon ..... B65D 1/165 72/111
4,919,294 A * 4/1990 Kawamoto ..... B65D 1/165 220/606
5,105,973 A * 4/1992 Jentzsch ..... B65D 1/165 220/606
5,355,709 A * 10/1994 Bauder ..... B21D 22/30 72/356
5,593,063 A * 1/1997 Claydon ..... B65D 79/0081 220/608
5,605,248 A * 2/1997 Jentzsch ..... B65D 1/26 215/373
5,730,314 A * 3/1998 Wiemann ..... B65D 1/165 220/609
5,934,127 A * 8/1999 Ihly ..... B21D 51/26 72/110
6,098,832 A * 8/2000 Jentzsch ..... B65D 1/0276 220/604
6,131,761 A * 10/2000 Cheng ..... B65D 1/165 220/608
6,182,852 B1 * 2/2001 Szwargulski ..... B65D 1/165 220/608
6,434,996 B1 * 8/2002 Aschberger ..... B21D 22/30 72/348
6,634,203 B1 * 10/2003 Ras ..... B21D 22/28 413/69
7,740,148 B2 * 6/2010 Rajagopalan ..... B65D 17/02 220/608
8,162,170 B1 * 4/2012 Massad ..... B65D 25/24 248/346.11
8,844,334 B2 9/2014 Roeterdink
2005/0109787 A1 * 5/2005 Rajagopalan ..... B65D 17/02 220/608
2009/0218250 A1 * 9/2009 Kubo ..... B21D 51/26 29/527.4
2016/0318645 A1 11/2016 Wersuhn
2017/0253371 A1 * 9/2017 Ramsey ..... B21D 51/383
2017/0305591 A1 * 10/2017 Derrien ..... B29C 49/0005
2018/0178947 A1 * 6/2018 Julius ..... B65D 17/02
2022/0169421 A1 * 6/2022 Komichi ..... B65D 17/02
2023/0173570 A1 * 6/2023 Fukumoto ..... B65D 1/16 72/70
2023/0201908 A1 * 6/2023 Fukumoto ..... B65D 1/165 428/34.1

FOREIGN PATENT DOCUMENTS

JP H9-285832 A 11/1997
JP 2016-043991 A 4/2016
JP WO 2020/158355 * 8/2020 ..... B12D 22/28
RU 2619414 C2 5/2017
WO WO2018/067249 A1 4/2018
WO WO2020/158355 A1 8/2020
WO WO22054361 A1 3/2022

OTHER PUBLICATIONS

Japanese Official Action cited in corresponding Japanese Appln. 2020-152159 dated Jun. 4, 2024, along with English translation.
English Translation of the ISR cited in PCT/JP2021/022873 International Application.
EESR cited in corresponding European Appln. No. EP21866322.7 dated Jul. 8, 2024.
Written Opinion of the ISA cited in PCT/ISA/237 dated Aug. 24, 2021, with EnglishTranslation.
Notice of Reasons for Refusal for JP 2020-152159 dated Feb. 5, 2024, with English Translation.
Official Action in corresponding Vietnamese Appln. No. 1-2023-01538 dated Nov. 29, 2024.

* cited by examiner

PREFORM OF A CAN AND METHOD OF MANUFACTURING THE SAME

CROSS-REFERENCE TO RELATED APPLICATIONS

The present application is a continuation application of PCT international application No. PCT/JP2021/022873 filed on Jun. 16, 2021 which claims priority from Japanese Patent Application No. 2020-152159 filed on Sep. 10, 2020, and the entire contents of which are hereby incorporated by reference.

BACKGROUND

1. Technical Field

The present invention relates to a preform of a can and a method of manufacturing the preform of the can.

2. Related Art

A two-piece can and a bottle can are known as a can body in which contents such as a drink and food can be contained. It is being promoted to thin the can body to reduce the weight of a can container, in order to cut down materials to be used. Even though the can container is thinned, the bottom shape of the can body is designed with various ideas to achieve a sufficient pressure resistance.

Generally, to increase the pressure resistance, there has been known a bottom shape of the can body having a dome part which is concave into the can body and an annular leg part provided around the dome part.

In order to further enhance the pressure resistance, the shapes of the dome part and the leg part have been appropriately designed, respectively. For example, Japanese Patent Application Laid-Open No. 2016-43991 discloses: forming a first concave curved surface which is formed on an inner peripheral wall (inner peripheral section) continuous with a dome part of an annular convex part (leg part) and is curved and concave toward the outside of the radial direction orthogonal to a can axis in a vertical cross-sectional view taken along the can axis; in the dome part, forming a dome top located on the can axis, and a second concave curved surface which is connected to the outside of the dome top in the radial direction and is curved and concave with a radius of curvature smaller than that of the dome top; and forming a linear tapered section which is formed on an outer peripheral section of the dome part, connects between the first concave curved surface and the second concave curved surface, and contacts the first concave curved surface and the second concave curved surface. The entire contents of this disclosure are hereby incorporated by reference.

SUMMARY

According to the invention, a preform of a can includes: a dome part on a bottom of a bottomed cylindrical body, the dome part being concave into the bottomed cylindrical body; and an annular leg part projecting in a direction opposite to a direction in which the dome part is concave, the dome part and the annular part being molded to form the preform of the can, and an inner surface of the dome part being pressed to mold a molded can. A maximum height of the preform of the can from a ground plane to the dome part is greater than a maximum height of the molded can from a ground plane to the dome part. In a vertical cross-sectional view taken along a can axis, a length of an inner peripheral section of the leg part connecting between a ground point of the leg part and the dome part of the preform of the can is greater than a length of a curved end molded around the dome part of the molded can.

According to the invention, a method of manufacturing a preform of a can includes: providing a bottomed cylindrical body; and molding the preform of the can including: molding a dome part on a bottom of the bottomed cylindrical body, the dome part being concave into the bottomed cylindrical body; and molding an annular leg part projecting in a direction opposite to a direction in which the dome part is concave. In the molding:

- a maximum height of the preform of the can from a ground plane to the dome part is greater than a maximum height of the molded can from a ground plane to the dome part; and in a vertical cross-sectional view taken along a can axis, a length of an inner peripheral section of the leg part connecting between a ground point of the leg part and the dome part of the preform of the can is greater than a length of a curved end molded around the dome part of the molded can. An inner surface of the dome part of the preform of the can is pressed to mold a molded can.

DETAILED DESCRIPTION

With the technology described in Japanese Patent Application Laid-Open No. 2016-43991, bottom reforming process is applied to the inner peripheral wall (inner peripheral section) of the annular convex part (leg part) to form the first concave curved surface and the tapered section, and the first concave curved surface is molded by using a roller. With this bottom reforming process with a roller, the first concave curved surface has a radius of curvature which is large enough to be subjected to the process with a roller. This limits to make the inner peripheral surface of the leg part more concave toward the outside of the radial direction orthogonal to the can axis.

In this way, it is difficult for the conventional bottom reforming process with a roller to reform the bottom into a desired shape, and consequently there is a problem of not being able to sufficiently improve the pressure resistance of the can body.

The present invention has been achieved considering the above-described circumstances to address the above-described problems. It is therefore an aspect of the object of the invention to improve the pressure resistance of a can body.

Figure 1:
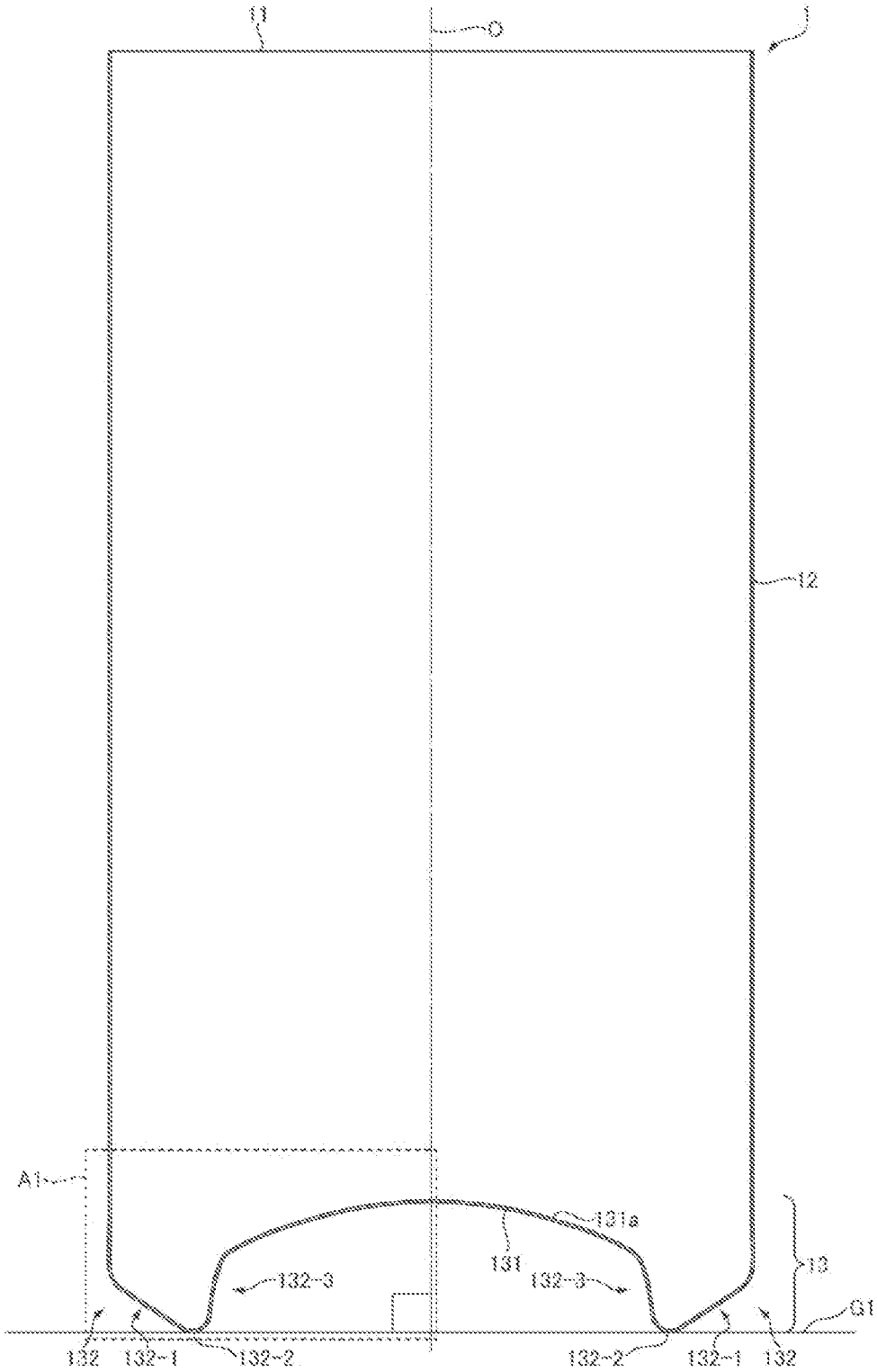
FIG. 1 is a vertical cross-sectional view illustrating a preform of a can according to an embodiment.
Figure 2:
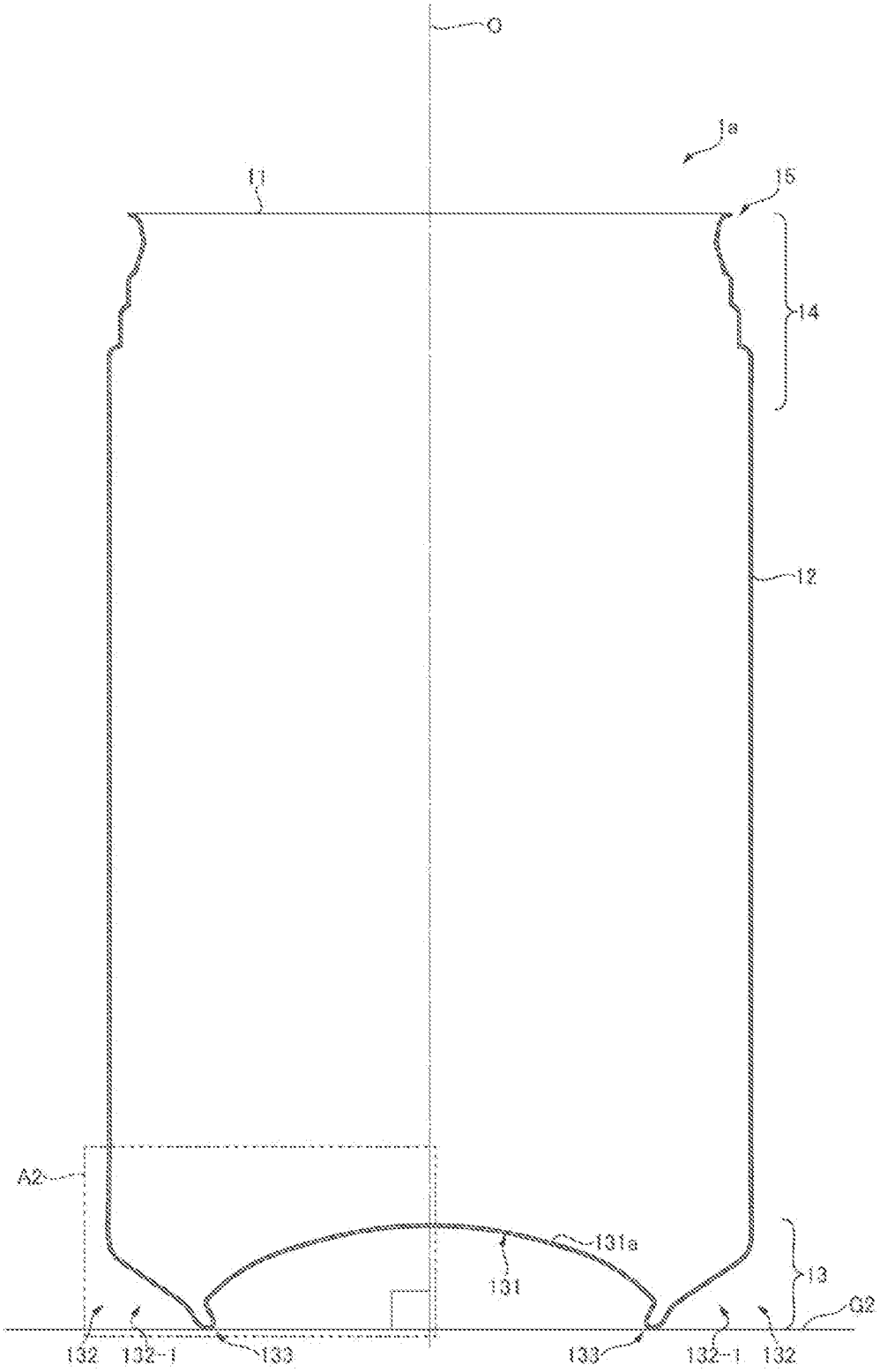
FIG. 2 is a vertical cross-sectional view illustrating a can body molded from the preform of the can.
Figure 3:
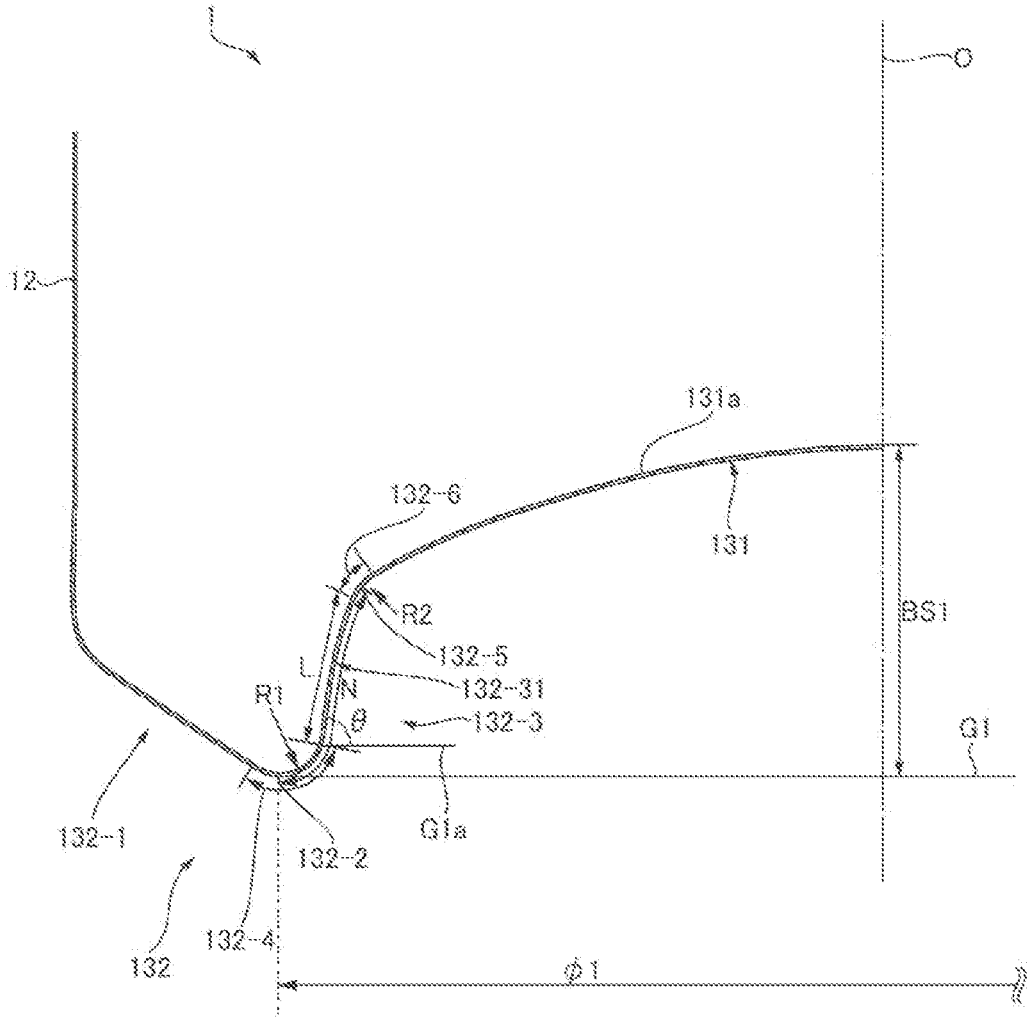
FIG. 3 is an enlarged view illustrating region A1 of FIG. 1.
Figure 4:
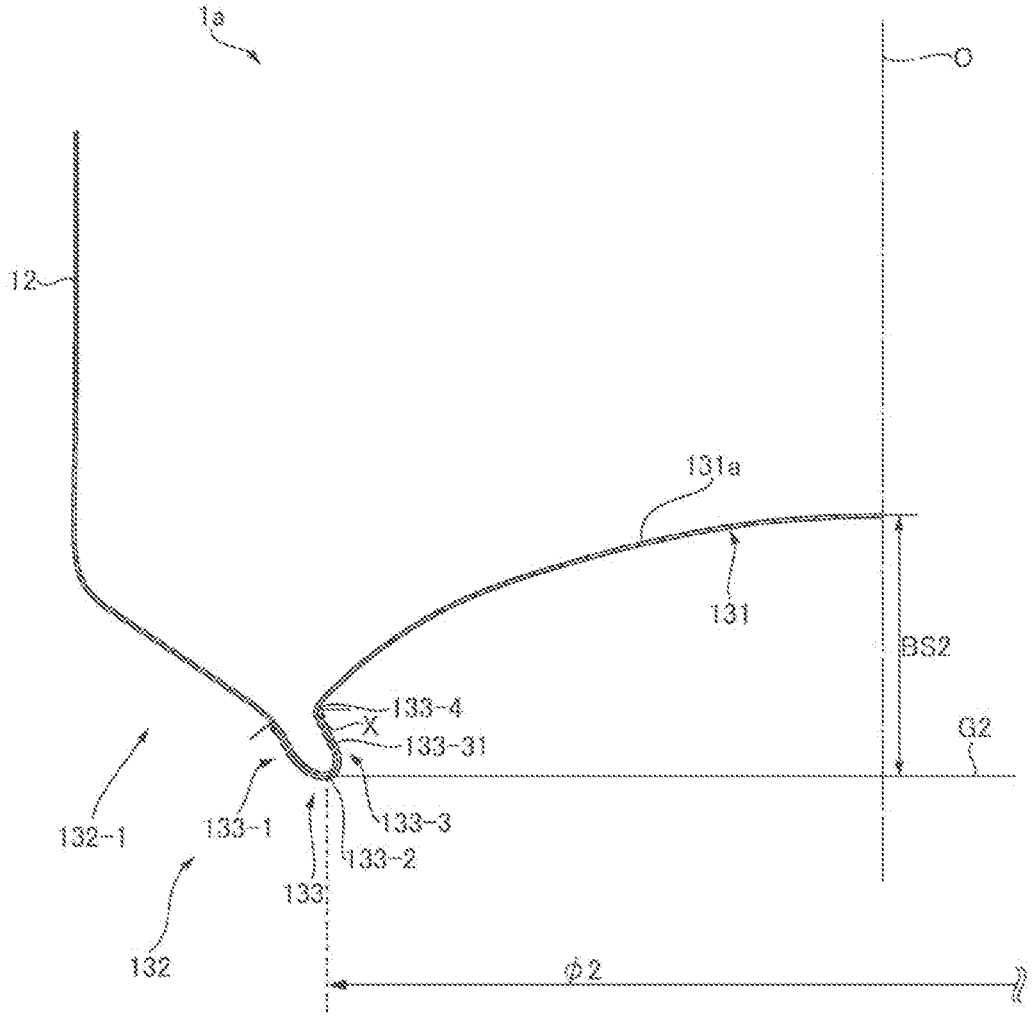
FIG. 4 is an enlarged view illustrating region A2 of FIG. 2.
Figure 5:
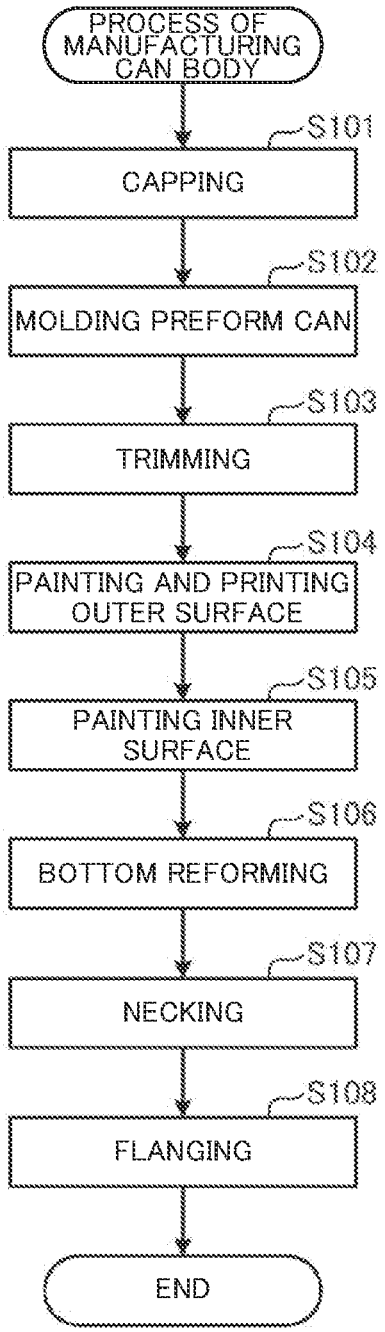
FIG. 5 is a flowchart illustrating a process of manufacturing the can body.
Figure 9:
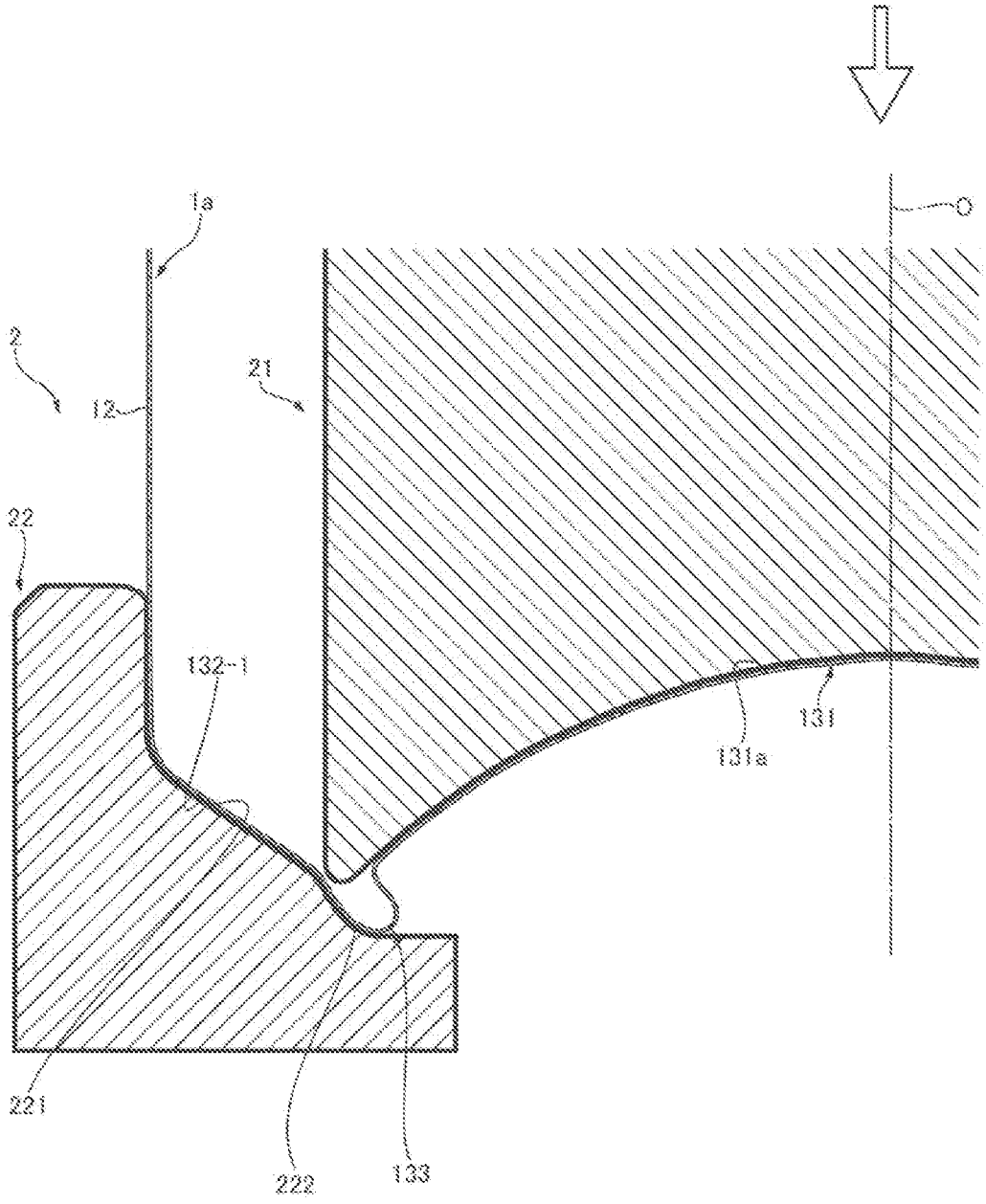
FIG. 9 is a partial cross-sectional view illustrating the molding device to mold the preform of the can.
Figure 10:
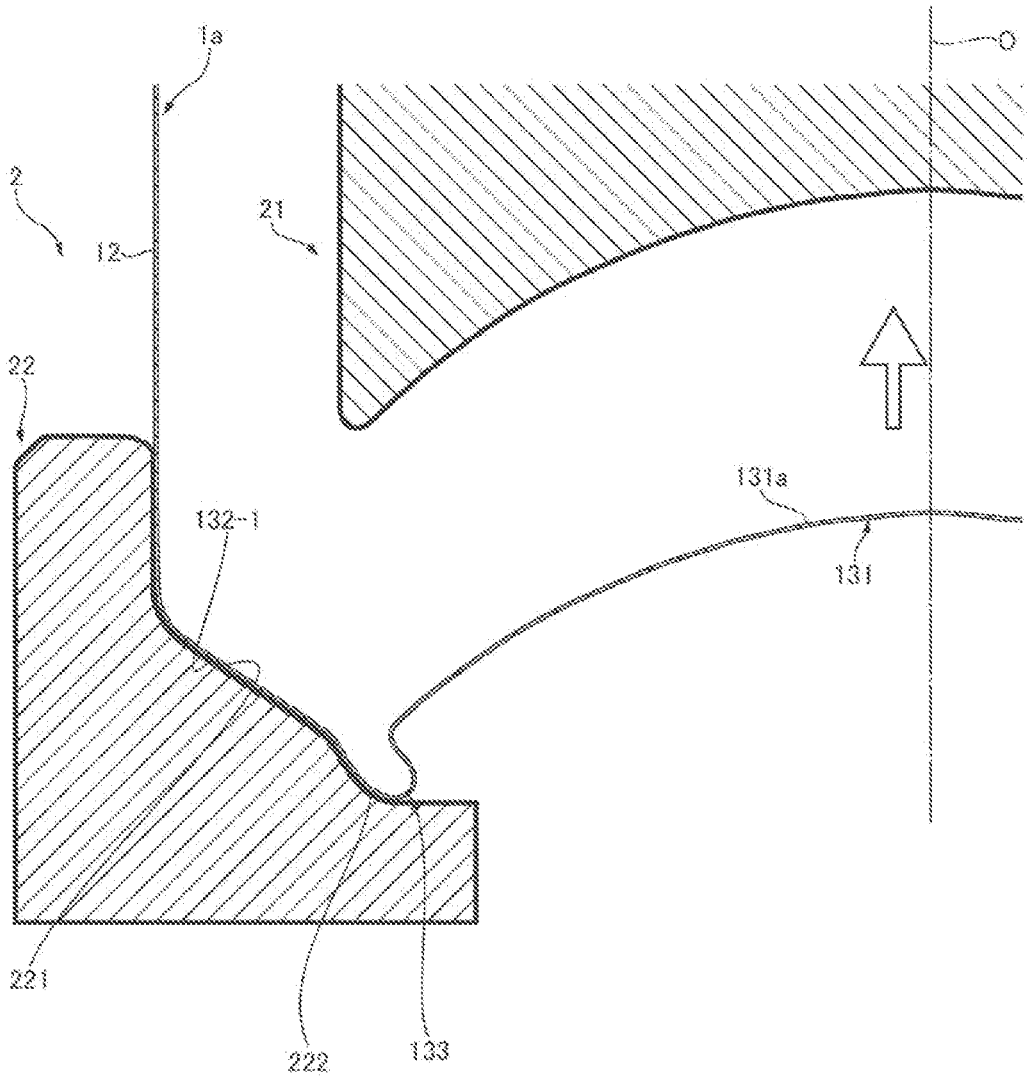
FIG. 10 is a partial cross-sectional view illustrating the molding device to mold the preform of the can.
Figure 11:
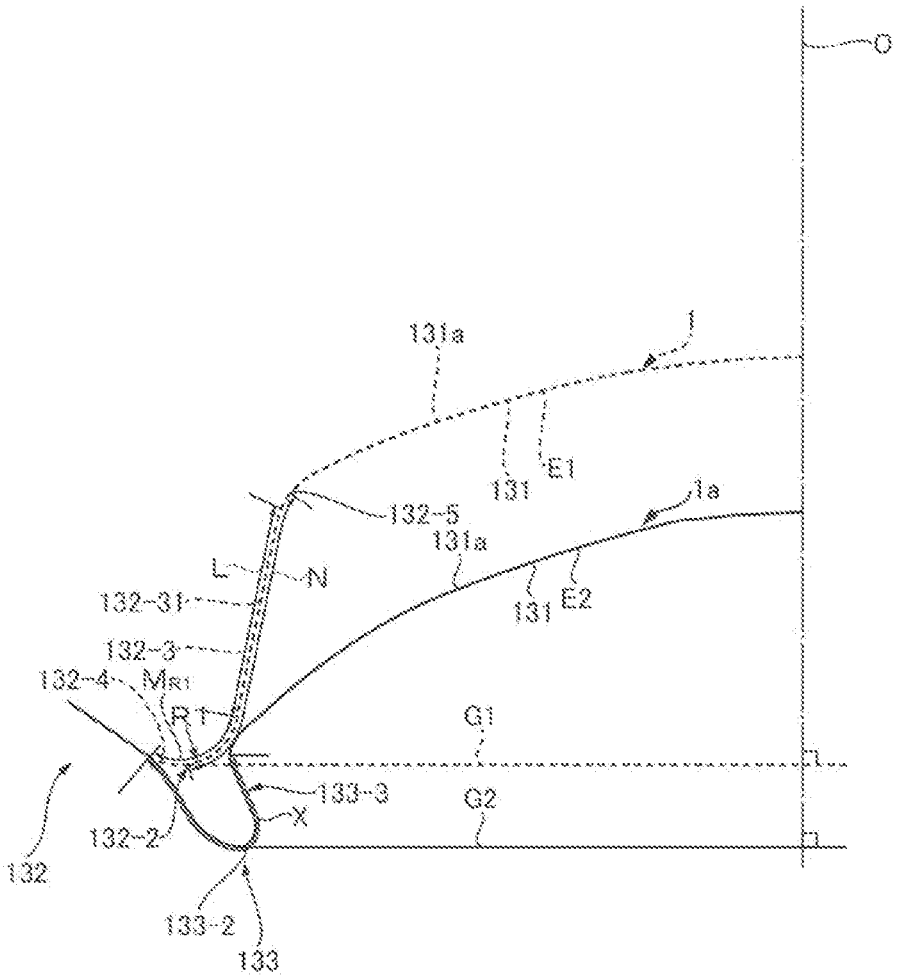
FIG. 11 is a partial cross-sectional view illustrating part of a leg part and a dome part before and after molding a curved end.

Hereinafter, an embodiment of the invention (present embodiment) will be described with reference to the drawings. FIG. 1 is a vertical cross-sectional view illustrating a preform of a can according to the present embodiment. FIG. 2 is a vertical cross-sectional view illustrating a can body molded from the preform of the can. FIG. 3 is an enlarged view illustrating region A1 of FIG. 1. FIG. 4 is an enlarged view illustrating region A2 of FIG. 2. FIG. 5 is a flowchart illustrating a process of manufacturing the can body. Each of FIG. 6 to FIG. 10 is a partial cross-sectional view illustrating a molding device to mold a preform of a can. FIG. 11 is a partial cross-sectional view illustrating part of a leg part and a dome part before and after molding a curved end.

FIG. 1 is a vertical cross-sectional view through which can axis O of a preform of a can 1 according to the embodiment passes. The preform of the can 1 is molded from a bottomed cylindrical body, and includes an opening 11, a cylindrical part 12, and a bottom 13. The cylindrical part 12 and the bottom 13 have the same shape across the entire circumference around the can axis O. The can axis O extends vertically to a ground plane G1 of the preform of the can 1. The bottom 13 includes a dome part 131 which is concave into the preform of the can 1, and an annular leg part 132 projecting in the direction opposite to the direction in which the dome part 131 is concave. The leg part 132 of the bottom 13 of the preform of the can 1 includes an outer wall 132-1 continuous with the cylindrical part 12, a ground point 132-2 contacting the ground plane G1, and an inner peripheral section 132-3 continuous with the dome part 131.

FIG. 2 is a vertical cross-sectional view through which the can axis O of a can body 1*a* molded from the preform of the can 1 passes. Also the can axis O of the can body 1*a* extends vertically to a ground plane G2. The can body 1*a* is a molded can molded by pressing an inner surface 131*a* of the dome part 131 and the outer wall 132-1 of the preform of the can 1 facing one another in the direction along the can axis O. By pressing the inner surface 131*a* of the dome part 131, the leg part 132 of the preform of the can 1 is partially deformed to mold a curved end 133. That is, the can body 1*a* illustrated in FIG. 2 includes the curved end 133 around the pressed dome part 131, which is molded from the leg part 132.

In addition, as illustrated in FIG. 2, the can body 1*a* includes a neck 14 having a diameter smaller than the outer diameter of the cylindrical part 12, and a flange 15 molded at the end (lip) of the neck 14 on the opening 11 side. The flange 15 is shaped to curl toward the outside of the can body 1*a* to hold and tighten a lid (not shown) thereafter.

FIG. 3 is an enlarged view illustrating a region A1 including the cylindrical part 12, the dome part 131, and the leg part 132 of the preform of the can 1 illustrated in FIG. 1. Meanwhile, FIG. 4 is an enlarged view illustrating a region A2 including the cylindrical part 12, the dome part 131, and the leg part 132 with the curved end 133 of the can body 1*a* illustrated in FIG. 2.

FIG. 3 is a vertical cross-sectional view taken along the can axis O where the leg part 132 of the bottom 13 of the preform of the can 1 includes the outer wall 132-1 continuous with the cylindrical part 12 and the inner peripheral section 132-3 continuous with the dome part 131, which are continuous with one another at the ground point 132-2 contacting the ground plane G1. A tip section 132-4 of the leg part 132 is formed by part of the outer wall 132-1 and part of the inner peripheral section 132-3, and is shaped in an approximately circular arc including the ground point 132-2 and having a radius of curvature R1. Meanwhile, a boundary section 132-6 is formed by part of the inner peripheral section 132-3 and part of the dome part 131, and is a shaped in an approximately circular arc including a boundary point 132-5 between the inner peripheral section 132-3 and the dome part 131 and having a radius of curvature R2.

FIG. 4 is a vertical cross-sectional view taken along the can axis O where the leg part 132 of the bottom 13 of the can body 1*a* molded from the preform of the can 1 includes the curved end 133 formed between the outer wall 132-1 continuous with the cylindrical part 12 and the dome part 131. This curved end 133 includes an outer peripheral section 133-1 continuous with the outer wall 132-1 and an inner peripheral section 133-3 continuous with the dome part 131, which are continuous with one another at a ground point 133-2 contacting the ground plane G2. In addition, the inner peripheral section 133-3 and the dome part 131 are continuous with one another at a boundary point 133-4. Moreover, in FIG. 4, the inner peripheral section 133-3 includes a tapered surface 133-31 which is an approximately straight line in the vertical cross-sectional view taken along the can axis O.

The maximum height of the preform of the can 1 from the ground plane G1 to the dome part 131 is BS1 as illustrated in FIG. 3, and the maximum height of the can body 1*a*, which is a molded can, from the ground plane G2 to the dome part 131 is BS2 as illustrated in FIG. 4. Here, BS2 may be smaller than BS1 (BS2<BS1 . . . (1)).

In addition, as illustrated in FIG. 3, a ground diameter which is a distance between two ground points 132-2 passing through the can axis O of the preform of the can 1 is φ1, and as illustrated in FIG. 4, a ground diameter which is a distance between two ground points 133-2 passing through the can axis O of the molded can body 1*a* is φ2. Here, φ2 may be smaller than φ1 (φ2<φ1 . . . (2)).

As a specific example, the preform of the can 1 may have BS1 of 13.75 mm, and φ1 of 49.0 mm, and in this case, the molded can body 1*a* may have BS2 of 11.20 mm, and φ2 of 45.5 mm.

In addition, as illustrated in FIG. 3, the inner peripheral section 132-3 of the leg portion 132 is inclined from the ground point 132-2 of the leg part 132 toward the can axis O with respect to the direction parallel to the can axis O in the vertical cross-sectional view taken along the can axis O. Meanwhile, as illustrated in FIG. 4, the inner peripheral section 133-3 connecting between the ground point 133-2 of the curved end 133 of the molded can body 1*a* and the dome part 131 is inclined toward the direction opposite to the direction in which the inner peripheral section 132-3 of the leg part 132 is inclined toward the can axis O as illustrated in FIG. 3, with respect to the direction parallel to the can axis O in the vertical cross-sectional view taken along the can axis O (that is, inclined from the ground point 133-2 toward the cylindrical part 12 with respect to the direction parallel to the can axis O).

The inner peripheral section 132-3 of the leg 132 of the preform of the can 1 illustrated in FIG. 3 has an approximately linear diameter reduction section 132-31 having length L in the vertical cross-sectional view taken along the can axis O. In FIG. 3, provided that an angle of inclination between the ground plane G1 of the preform of the can 1 (or a plane G1*a* parallel to the ground plane G) and the approximately linear diameter reduction section 132-31 toward the can axis O is θ, it is preferred that the radius of curvature R1 is 0.8 mm to 2.2 mm, the length L is 4.0 mm to 7.0 mm, and the angle of inclination θ is 70 degrees to 85 degrees (R1=0.8 mm to 2.2 mm, L=4.0 mm to 7.0 mm, θ is 70 degrees to 85 degrees . . . (3)). As a specific example, the radius of curvature R1 may be 1.7 mm, the length L may be 5.9 mm, and the angle of inclination θ may be 80 degrees.

In the can body 1*a* (molded can) illustrated in FIG. 4, the curved end 133 around the dome part 131 is molded at least from the inner peripheral section 132-3 of the leg part 132 of the preform of the can 1 illustrated in FIG. 3.

Provided that the inner peripheral section 132-3 of the leg part 132 connecting between the ground point 132-2 of the leg part 132 of the preform of the can 1 and the dome part 131 has length N in the vertical cross-sectional view taken along the can axis O illustrated in FIG. 3, and the curved end 133 molded around the dome part 131 of the can body 1*a* (molded can) has length X in the vertical cross-sectional view taken along the can axis o illustrated in FIG. 4, it is preferred that X is smaller than N (X<N . . . (4)) because a desired shape of the curved end 133 is stably obtained in the bottom reforming process.

Next, a process of manufacturing the can body 1*a* will be described using the flowchart illustrated in FIG. 5. The can body 1*a* is manufactured in the process with the following step S101 to step S108.

<Step S101: Cupping>

In step S101 of cupping, a metal plate made of, for example, aluminum alloy is punched out into a circle, and drawing (cupping) is applied to the obtained circular metal plate with a cupping press to mold a cup-shaped body.

<Step S102: Molding a Preform of a Can>

In step S102 of molding a preform of a can subsequent to the step S101, drawing and ironing is applied to the cup-shaped body molded in the step S101; a bottomed cylindrical body including a cylindrical part and a bottom is molded; pressing is further applied to the bottom of the bottomed cylindrical body; and a dome part which is concave into the bottomed cylindrical body, and an annular leg part projecting in the direction opposite to the direction in which the dome part is concave are molded. Consequently, the preform of the can 1 is molded. Here, when a lubricant and so forth is used in the step S101 and the step S102, a cleaning step to remove the lubricant may be added after the step S102.

<Step S103: Trimming>

The preform of the can 1 molded in the step S102 has an uneven height because its opening end has a lug. Therefore, in step S103 subsequent to the step S102, trimming to trim (cut) the lug of the opening end of the preform of the can 1 is performed by using a trimming device to even the height of the preform of the can 1 across the entire circumference.

<Step S104: Painting and Printing the Outer Surface>

In step S104 of painting and printing the outer surface subsequent to the step S103, the outer surface of at least the cylindrical part 12 and the bottom 13 of the preform of the can 1 is painted with a painting material for the outer surface to form a coating film, and then a design image is printed on the outer surface (outer peripheral surface) of the cylindrical part 12. In addition, this printed surface with the design image may be coated with varnish to form an overcoat layer, and then the overcoat layer may be dried and baked in an oven. By this means, it is possible to finish the outer surface of the preform of the can 1 with improved smoothness and wearing resistance.

<Step S105: Painting the Inner Surface>

In step S105 of painting the inner surface subsequent to the step S104, the inner surface of the preform of the can 1 is painted with a painting material for the inner surface. This painting may be performed, for example, with a spray device.

As an example of the painting material for the inner surface used herein, a painting material composition containing epoxy-acrylic copolymers and aqueous solvent may be given. In this way, the inner surface 131*a* of the preform of the can 1 is painted, and therefore it is possible to prevent the flavor of the content from reducing, and also to prevent corrosion of the metal. Here, after the step S105 of painting the inner surface, a drying step to dry the preform of the can 1 at a high temperature, for example, about 190 degrees Celsius to 210 degrees Celsius may be added.

<Step S106: Bottom Reforming>

In step S106 of bottom reforming subsequent to the step S105, the preform of the can 1 is pressed such that the inner surface 131*a* of the dome part 131 of the preform of the can 1 painted in the step S105 and the outer wall 132-1 which face one another are pressed in the direction along the can axis O. By this means, it is possible to mold the can body 1*a* (molded can) including the curved end 133 around the dome part 131.

Figure 6:
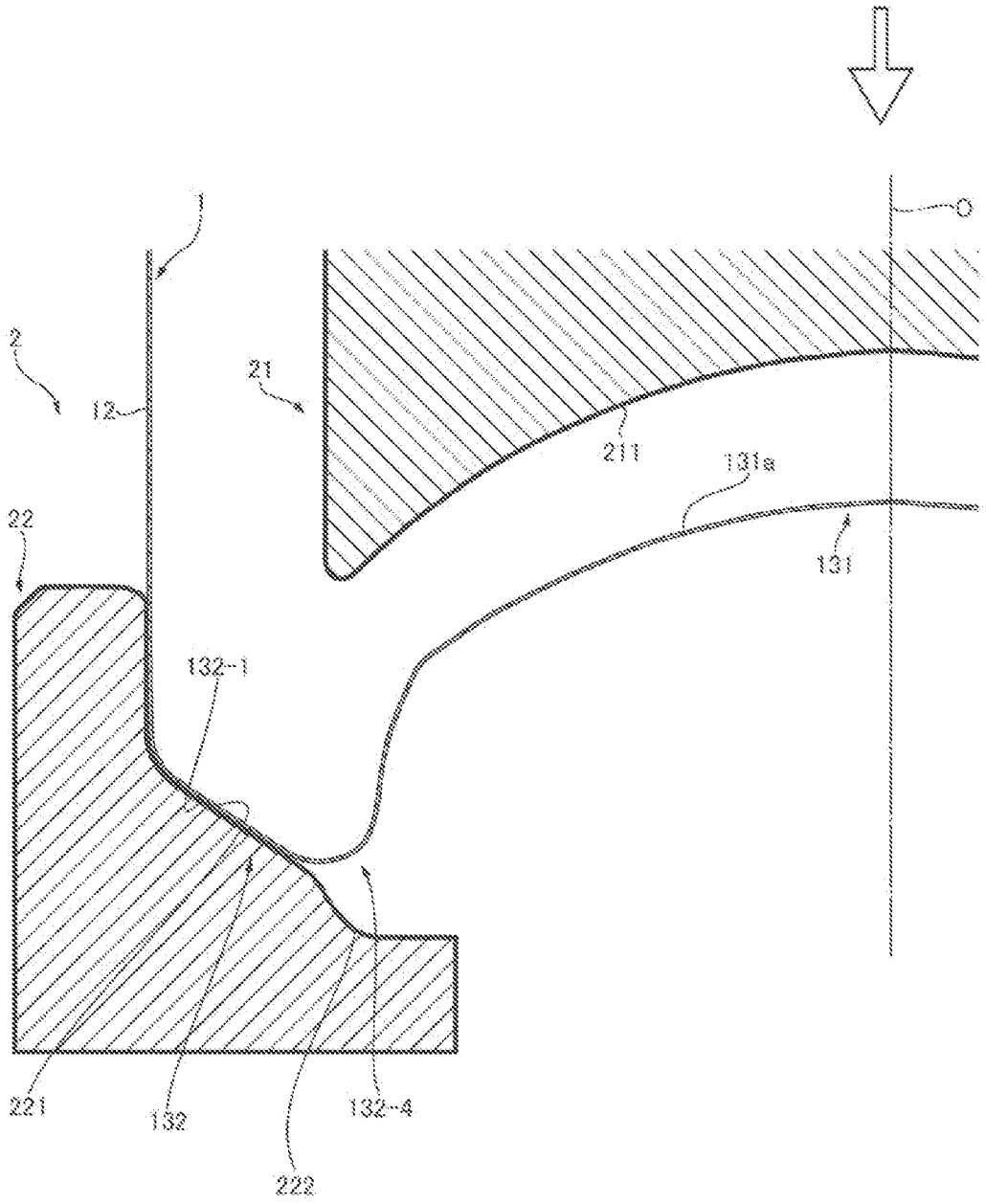
FIG. 6 is a partial cross-sectional view illustrating a molding device to mold a preform of a can.

In this bottom reforming, pressing is performed by using, for example, a molding device 2 illustrated in FIG. 6. The molding device 2 includes a press object 21 configured to be inserted into the preform of the can 1 and contact the inner surface of the dome part 131, and a shaping die 22 to mold the curved end 133 by the pressing of the press object 21.

First, the preform of the can 1 is placed on the shaping die 22 of the molding device 2 such that the outer wall 132-1 of the leg part 132 of the preform of the can 1 contacts a contact surface 221 of the shaping die 22 of the molding device 2 as illustrated in FIG. 6. Next, the press object 21 of the molding device 2 is moved toward the inner surface 131*a* of the dome part 131 (in the arrow direction along the can axis O), also as illustrated in FIG. 6.

Figure 7:
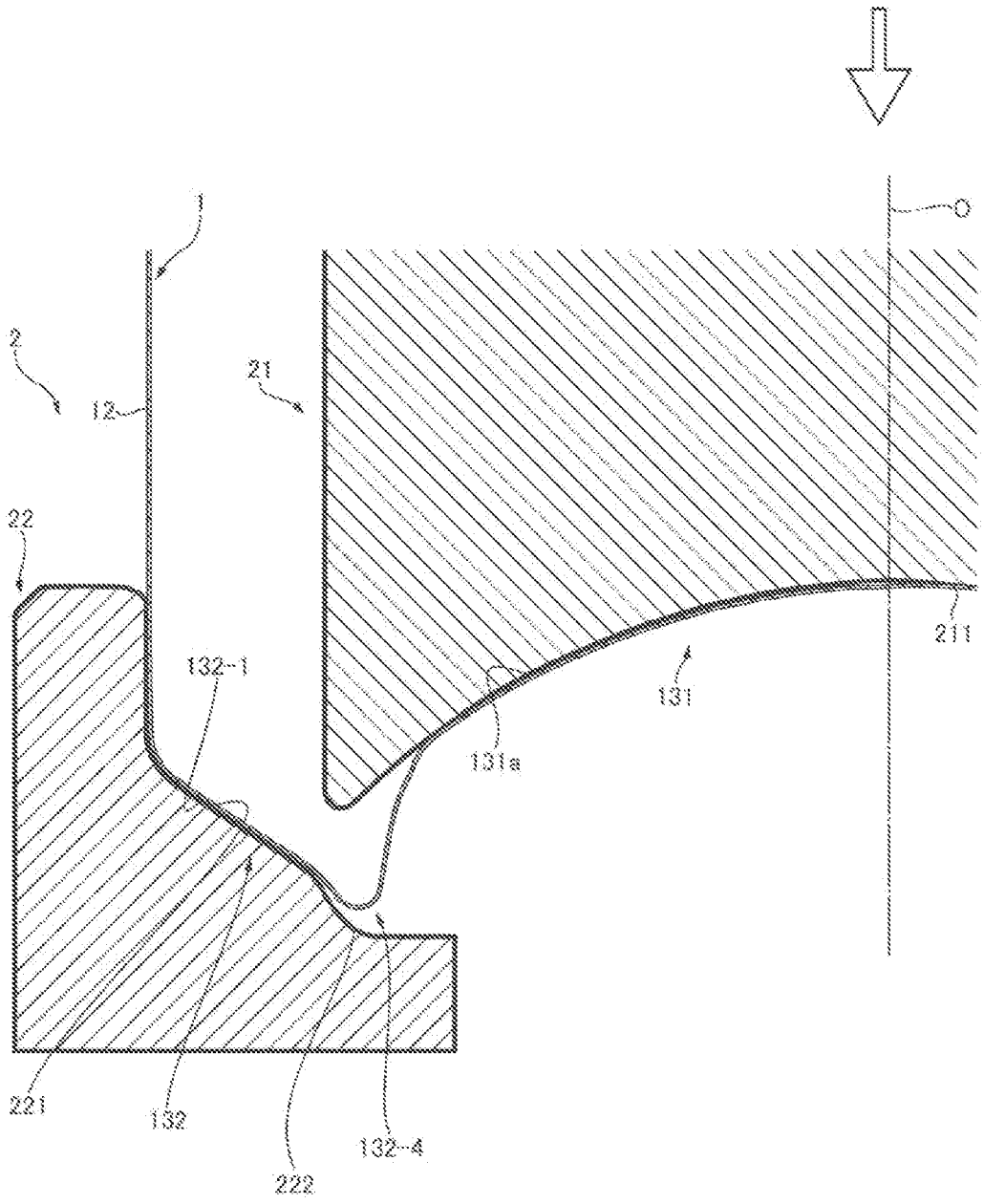
FIG. 7 is a partial cross-sectional view illustrating the molding device to mold the preform of the can.

Then, the press object 21 continues to further move in the arrow direction along the can axis O as illustrated in FIG. 7. By this means, the pressing surface 211 of the press object 21 contacts to press the inner surface 131*a* of the dome part 131. By the pressing as described above, a pressing force from the contact surface 221 of the shaping die 22 is applied to the outer wall 132-1, and the tip section 132-4 of the leg part 132 of the preform of the can 1 is deformed from the contact surface 221 of the shaping die 22 to fit a curve shaping surface 222 as illustrated in FIG. 7.

Figure 8:
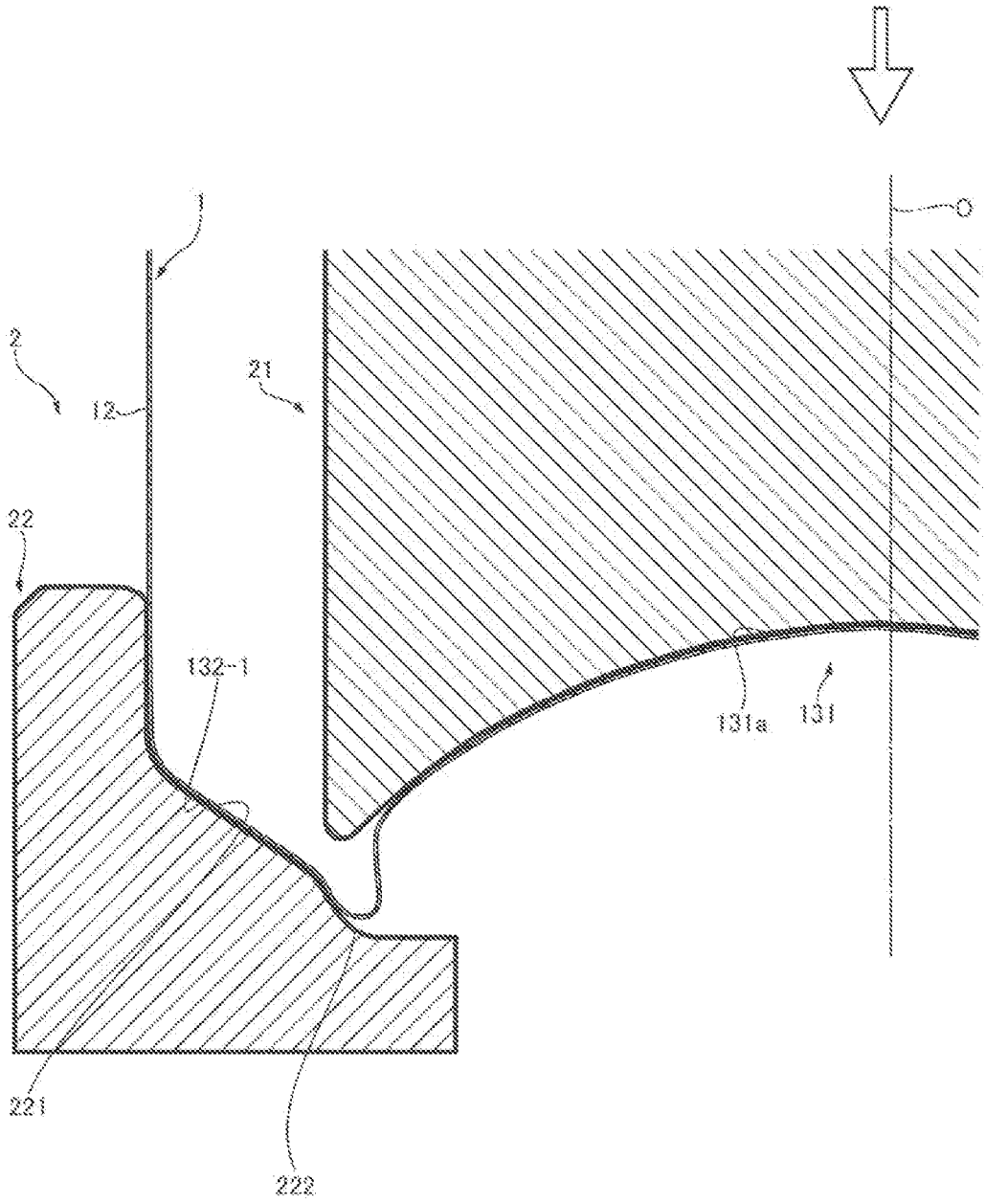
FIG. 8 is a partial cross-sectional view illustrating the molding device to mold the preform of the can.

After that, as illustrated in FIG. 8, the press object 21 continues to further press the inner surface 131*a* of the dome part 131 in the arrow direction as illustrated in FIG. 8, and therefore an additional pressing force from the contact surface 221 of the shaping die 22 is applied to the outer wall 132-1. By this means, part of the leg part 132 of the preform of the can 1 is guided to the curve shaping surface 222, and therefore deformed to fit the curve shaping surface 222. Then, the curved end 133 fitting the curve shaping surface 222 as illustrated in FIG. 9 is molded. By molding this curved end 133, the can body 1*a* as a molded can is obtained. After that, as illustrated in FIG. 10, the press object 21 of the molding device 2 is moved in an arrow direction along the can axis O, which is opposite to the pressing direction, to space the press object 21 of the molding device 2 from the inner surface 131*a* of the dome part 131. Then, the can body 1*a* is removed from the molding device 2. In contract, the preform of the can 1 may be placed on the press object 21 of the molding device 2, and the shaping die 22 of the molding device 2 may be moved and spaced from the outer wall 132-1 of the leg part 132 of the preform of the can 1, and then the can body 1*a* may be removed from the molding device 2.

As described above, in the step S106 of bottom reforming, the curved end 133 is molded by pressing the inner surface 131*a* of the dome part 131. By this means, it is possible to incline the inner peripheral section 133-3 of the curved end 133 from the ground point 132-2 toward the cylindrical part 12 with respect to the direction parallel to the can axis O. Therefore, it is possible to secure a sufficient length of the inner peripheral section 133-3. That is, the inner peripheral section 133-3 of the curved end 133 can be more concave toward the cylindrical part 12 than the conventional bottom reforming process using a roller. Therefore, it is possible to achieve a sufficient pressure resistance of the bottom 13 of the molded can body 1*a*.

<Step S107: Necking>

In step S107 of necking subsequent to the step S106, a neck 14 is molded by applying die process (necking process) stepwise to the end of the cylindrical part 12 of the can body 1*a* on the opening 11 side by using a die process tool (necking die) (not shown).

<Step S108: Flanging>

In step S108 of flanging subsequent to the step S107, the end (lip) of the opening 11 is curled toward the outside of the can body 1*a* by using a roller (not shown) to mold the flange 15. The shape of the flange 15 is made to hold and fasten the lid thereafter.

Here, the step S107 of necking and the step S108 of flanging may be performed before the step S106 of bottom reforming.

By the step S101 to the step S108 described above, the can body 1*a* is manufactured as a molded can. Here, after the step S108, a drink is stored in the can body 1*a* as a content, and a step of holding and fastening to tightly seal the flange 15 and the lid (not shown) together is performed. By this means, a can container storing the drink, as a drink product, is manufactured.

According to the process of manufacturing the can body 1*a*, it is assured that the inner surface of the leg part 132 of the preform of the can 1 before the curved end 133 is molded has the inclined surfaces such as the outer wall 132-1 and the approximately linear diameter reduction section 132-31 in the vertical cross-sectional view taken along the can axis O across the entire circumference. In particular, the approximately linear diameter reduction section 132-31 is inclined from the ground point 133-2 toward the opening of the can body 1*a* and the can axis O, rather than the inner surface of the inner peripheral wall of the annular convex part (leg part) of the can according to the conventional technology described in, for example, Japanese Patent Application Laid-Open No. 2016-43991. Therefore, the painting material sprayed by using a spray device in the painting work easily reaches the inner surface of the inner peripheral section 132-3, as well as the inner surface 131*a* of the dome part 131 and the inner surface of the outer wall 132-1. By this means, for the bottom 13 of the preform of the can 1, it is possible to paint the inner surface of the leg part 132 without the waste of the painting material, and also to reduce the difference in the thickness of the coating film of the painting material for the inner surface to even the thickness. The same applies to the painting of the outer surface of the leg part 132 of the preform of the can 1.

Moreover, according to the process of manufacturing the can body 1*a*, the inner surface and the outer surface of the preform of the can 1 are painted, and then, the preform of the can 1 is subjected to the bottom reforming by pressing the inner surface 131*a* of the dome part 131 as described above. Therefore, any load such as friction due to a roller is not applied like the conventional bottom reforming process by using the roller. Therefore, the process of manufacturing the can body 1*a* eliminates such a problem that the coating film on the inner surface and the outer surface of the leg part formed by previously painting the inner surface and the outer surface of the preform of the can 1*a* is prone to be peeled off.

Meanwhile, if the conventional bottom reforming process with a roller is applied to the outer surface of the preform of the can 1 from the outside of the inner peripheral section 132-3 of the leg part 132, the aluminum oxide film is damaged by a load such as friction. This could generate rolling process marks (blacking) during sterilization by heating after the content is filled. As a result, the molded can body 1*a* could be disfigured. However, the process of manufacturing the can body 1*a* described above does not have this problem of disfiguring.

Moreover, the process of manufacturing the can body 1*a* is simple in such a way that the inner surface 131*a* of the dome part 131 of the preform of the can 1 and the outer wall 132-1 facing one another are pressed in the direction along the can axis O. By this means, it is possible to mold the curved end 133 which is a structure to improve the pressure resistance of the bottom 13 around the dome part 131. This process is far simpler than a way in which the curved end 133 is molded by the bottom reforming process with a roller from the outside of the inner peripheral section 132-3 of the leg part 132. Moreover, this process is different from the conventional technology of the bottom reforming process with a roller in that friction between the leg part 132 and the shaping die 22 is small. Therefore, the painting material is not built up on the shaping die 22.

Next, the length of the cross section of the curved end 133 molded in the leg part 132 will be described with reference to FIG. 11. In the vertical cross-sectional view taken along the can axis O of FIG. 11, dotted line E1 indicates part of the leg part 132 and the dome part 131 of the preform of the can 1 before the curved end 133 is molded, and solid line E2 indicates part of the leg part 132 and the dome part 131 of the can body 1*a* after the curved end 133 is molded. In addition, in FIG. 11, dotted line G1 indicates the ground plane on which the preform of the can 1 is grounded at the ground point 132-2, and solid line G2 indicates the ground plane on which the molded can body 1*a* is grounded at the ground point 133-2.

In the vertical cross-sectional view taken along the can axis O of FIG. 11, the inner peripheral section 132-3 of the leg part 132 of the preform of the can 1 is inclined from the ground point 132-2 of the leg part 132 toward the can axis O with respect to the direction parallel to the can axis O orthogonal to the ground plane G1. The above-described pressing is applied to the inner surface 131*a* of the dome part 131 of the preform of the can 1 to mold the curved end 133 as indicated by the solid line E2. In the can body 1*a* (molded can) after the curved end 133 is molded, the inner peripheral section 133-3 of the curved end 133 connecting between the ground point 133-2 of the curved end 133 and the dome part 131 is inclined toward the direction opposite to the direction in which the inner peripheral section 132-3 of the leg part 132 is inclined toward the can axis O, with respect to the direction parallel to the can axis O (that is, inclined from the ground point 133-2 toward the cylindrical part 12 with respect to the direction parallel to the can axis O).

In the vertical cross-sectional view taken along the can axis O of FIG. 11, length N of the inner peripheral section 132-3 of the leg part 132 connecting between the ground point 132-2 of the leg part 132 and the dome part 131 of the preform of the can 1 is greater than length X of the curved end 133 molded around the dome part 131 of the can body 1*a* (molded can), as represented by the above-described expression (4).

Then, provided that the length of an approximately circular arc forming tip section 132-4 of the leg part 132 on the dotted line E1 and having the radius of curvature R1 is $M_{R1}$, and the length of the diameter reduction section 132-31 of the inner peripheral section 132-3 of the leg part 132 on the dotted line E1, which is an approximately linear in the vertical cross-sectional view taken along the can axis O is L, it is preferred that X is smaller than $M_{R1}$ plus L ($X<M_{R1}+L$ . . . (5)) because a desired shape of the curved end 133 can be stably provided in the bottom reforming process. As a specific example, for example, $M_{R1}$ may be 3.44 mm, L may be 5.9 mm, and X may be 7.03 mm.

With the present embodiment, it is preferred that the preform of the can 1 is molded with the numerical design that satisfies the above-described expressions (1) to (5). By pressing the inner surface 131*a* of the dome part 131 of the preform of the can 1 molded with this design, it is possible to mold the can body 1*a* (molded can) including the curved end 133 fitting the curve shaping surface 222.

The inner peripheral section 133-3 of the curved end 133 is more concave toward the cylindrical part 12 than the conventional can body subjected to the bottom reforming process using a roller. Therefore, it is possible to achieve a sufficient pressure resistance of the bottom 13 of the can body 1*a*.

Here, with the above-described embodiment, the inner surface and the outer surface of the preform of the can 1 are painted, but this is by no means limiting. At least one of the inner surface and the outer surface of the preform of the can 1 may be painted. Also in this case, the bottom reforming is performed by pressing the inner surface 131*a* of the dome part 131 as described above. Therefore, the problem that the coating film is prone to be peeled off as described above does not occur.

According to the invention, it is possible to improve the pressure resistance of a can body.

The invention claimed is:

1. A preform of a can comprising:

a dome part on a bottom of a bottomed cylindrical body, the dome part being concave into the bottomed cylindrical body; and an annular leg part projecting in a direction opposite to a direction in which the dome part is concave, the dome part and the annular leg part being molded to form the preform of the can, and an inner surface of the dome part being pressed to mold a molded can, wherein:

a maximum height of the preform of the can from a ground plane to the dome part is greater than a maximum height of the molded can from a ground plane to the dome part;

in a vertical cross-sectional view taken along a can axis, a length of an inner peripheral section of the annular leg part connecting between a ground point of the annular leg part and the dome part of the preform of the can is greater than a length of a curved end molded around the dome part of the molded can, provided that, in the vertical cross-sectional view taken along the can axis, an approximately circular arc forming a tip section of the annular leg part and having a radius of curvature R1 is MR1, a length of an approximately linear diameter reduction section of the inner peripheral section of the annular leg part is L, a length of the curved end of the molded can is X, and X is smaller than MR1 plus L ($X<MR1+L$); and provided that, in the vertical cross-sectional view taken along the can axis, an angle of inclination between the ground plane of the preform of the can and the diameter reduction section of the inner peripheral section of the annular leg part is θ, R1 is 0.8 mm to 2.2 mm, L is 4.0 mm to 7.0 mm, and θ is 70 degrees to 85 degrees.

2. The preform of the can according to claim 1, wherein:

in the vertical cross-sectional view taken along the can axis, the inner peripheral section of the annular leg part is inclined from the ground point of the annular leg part toward the can axis; and in the vertical cross-sectional view taken along the can axis, an inner peripheral section of the curved end connecting between a ground point of the curved end and the dome part of the molded can is inclined from the ground point of the curved end toward a direction opposite to the can axis.

3. A method of manufacturing a preform of a can, comprising:

providing a bottomed cylindrical body; and molding the preform of the can including:

molding a dome part on a bottom of the bottomed cylindrical body, the dome part being concave into the bottomed cylindrical body; and molding an annular leg part projecting in a direction opposite to a direction in which the dome part is concave, wherein, in the molding:

the preform of the can, an inner surface of the dome part of which is pressed to mold a molded can, is molded such that a maximum height of the preform of the can from a ground plane to the dome part is greater than a maximum height of the molded can from a ground plane to the dome part;

in a vertical cross-sectional view taken along a can axis, a length of an inner peripheral section of the annular leg part connecting between a ground point of the annular leg part and the dome part of the preform of the can is greater than a length of a curved end molded around the dome part of the molded can, provided that, in the vertical cross-sectional view taken along the can axis, an approximately circular arc forming a tip section of the annular leg part and having a radius of curvature R1 is MR1, a length of an approximately linear diameter reduction section of the inner peripheral section of the annular leg part is L, a length of the curved end of the molded can is X, and X is smaller than MR1 plus L ($X<MR1+L$); and provided that, in the vertical cross-sectional view taken along the can axis, an angle of inclination between the ground plane of the preform of the can and the diameter reduction section of the inner peripheral section of the annular leg part is θ, R1 is 0.8 mm to 2.2 mm, L is 4.0 mm to 7.0 mm, and θ is 70 degrees to 85 degrees.

* * * * *